United States Patent [19]

McNair, Jr.

[11] 4,167,930

[45] Sep. 18, 1979

[54] INTERNAL COMBUSTION ENGINE WITH SUSTAINED POWER STROKE

[75] Inventor: Robert J. McNair, Jr., Cincinnati, Ohio

[73] Assignee: Avco Corporation, Huntsville, Ala.

[21] Appl. No.: 927,214

[22] Filed: Jul. 24, 1978

[51] Int. Cl.[2] ..... F02B 23/00; F02M 27/00

[52] U.S. Cl. ..... 123/191 B; 123/32 E; 123/32 K; 123/75 B; 123/191 SP; 123/DIG. 4

[58] Field of Search ..... 123/22, 26, 32 E, 32 K, 123/32 L, 32 SP, 32 ST, 75 B, 119 E, 119 EE, 191 B, 191 C, 191 SP, 198 A, DIG. 4

[56] References Cited

U.S. PATENT DOCUMENTS

| | | | |
|---|---|---|---|
| 1,944,352 | 1/1934 | Lang | 123/32 E |
| 2,217,942 | 10/1940 | Cairns | 123/75 B |
| 2,442,664 | 6/1948 | Roensch | 123/32 E |
| 2,573,536 | 10/1951 | Bodine, Jr. | 123/191 B |
| 3,063,438 | 11/1962 | Bodine, Jr. | 123/191 B |
| 3,658,046 | 4/1972 | Winkler | 123/32 ST |
| 3,834,364 | 9/1974 | Bartholomew | 123/191 B |
| 3,973,530 | 8/1976 | Seidel | 123/32 L |
| 3,983,858 | 10/1976 | Sevald | 123/32 ST |
| 3,987,776 | 10/1976 | Goto et al. | 123/DIG. 4 |
| 4,060,059 | 11/1977 | Blaser | 123/32 ST |

*Primary Examiner*—Charles J. Myhre
*Assistant Examiner*—David D. Reynolds
*Attorney, Agent, or Firm*—Robert J. McNair, Jr.; Irwin P. Garfinkle

[57] ABSTRACT

A four stroke cycle internal combustion engine is presented having a sustained power stroke which results from a delayed mixing of a stratified charge. Use of delayed mixing of an overall stoichiometric air-fuel mixture results in formation of a low amount of the oxides of nitrogen. Delayed mixing of the stratified charge is achieved by placement of a Helmholtz resonator cavity in the head or closed end of each combustion chamber. The Helmholtz resonator cavity communicates with the main combustion chamber via a narrow slot made around the periphery of the top end of the chamber. On the intake stroke of each engine cylinder, the main chamber is filled with a slightly fuel rich gaseous charge while the companion Helmholtz resonator cavity is filled with air. During the compression stroke some of the rich air-fuel mixture is forced into the resonator cavity via the communicating slot. At or near TDC, the air-fuel mixture in the main chamber is ignited. As the flame front progresses across the chamber a rapid increase in pressure serves not only to power the piston, but also to initiate a resonant reaction in the Helmholtz resonator cavity which results in a transfer of the unburned gases therein into the main combustion chamber. This both sustains the power stroke and at the same time lowers the peak flame temperature in the main chamber.

7 Claims, 4 Drawing Figures

INTERNAL COMBUSTION ENGINE WITH SUSTAINED POWER STROKE

BACKGROUND OF THE INVENTION

This invention relates to an internal combustion engine having reduced emissions of nitrogen oxides. Much has been done in recent years to reduce the harmful products of combustion. The Environmental Protection Agency publication No. EPA-460/3-76-022 titled, "Nitrogen Oxide Control with the Delayed-Mixing, Stratified-Charge Engine Concept," authored by L. W. Evers, P. S. Myers and O. A. Uyehara present many of the methods that have been explored for controlling nitrogen oxide emissions.

Catalytic converters and other types of thermal reactors have been added to existing engines to reduce the harmful content of emissions after they leave the combustion chamber.

The U.S. Department of Commerce publication No. DOT-TSC-OST-75-56 titled, "Stratified Charge Engines" authored by Eric M. Withjack describes the operation of two open chamber stratified charge engines. One is the Ford Programmed Combustion Process (PROCO) engine. The other is the Texaco Controlled Combustion System (TCCS) engine.

The U.S. Patents to Goto (U.S. Pat. No. 3,987,776), Winkler (U.S. Pat. No. 3,658,046) and Blaser (U.S. Pat. No. 4,060,059) disclose internal combustion engines which achieve fuel mixture separation within the combustion chamber into rich and lean zones. Goto does this by successively supplying air and a fuel rich mixture by the same path. Winkler achieves a varying degree of fuel richness by centrifugal action. Blaser adds additional air to the combustion chamber so that the gas layer immediately above the piston head is fuel lean when the piston is at bottom-dead-center on the intake stroke. Subsequent engine work by Blaser after the filing of the application which issued as U.S. Pat. No. 4,060,059 is described in U.S. Naval Academy publication Number EW 8-76 titled, "The Naval Academy Heat Balanced Engine (NAHBE)", authored by R. Blasing, A. Pouring, B. Rankin and E. Keating, dated June 1976.

My invention differs from all of the above described engines. With my engine, the air-to-fuel ratio within the cylinder is progressively changed during the power stroke portion of the cycle. At ignition the air-to-fuel ratio in the main combustion chamber is preset to be on the fuel rich side. With the build up of combustion chamber pressure, as the flame front progresses across the chamber, additional fuel-lean air is added to the main chamber. This cools the flame, reduces formation of nitric and nitrous oxides and at the same time allows the combustion process to be carried to completion, thereby also reducing formation of both carbon monoxide and hydrocarbons.

SUMMARY OF THE INVENTION

My invention pertains to an internal combustion engine wherein the fuel-air mixture within the cylinder is progressively changed during the power stroke portion of the cycle. This progressive change from a fuel-rich to a fuel-lean condition is achieved by means of a Helmholtz resonator cavity placed in the head or closed end of the combustion chamber. The Helmholtz resonator cavity communicates with the combustion chamber through a narrow slit made around the periphery of the top end of the combustion chamber.

At the beginning of the intake stroke, air is introduced into the resonator. Meanwhile, a somewhat rich air-fuel mixture is fed into the main combustion chamber via the intake manifold and the open intake valve. During the compression stroke, some of the rich air-fuel mixture is forced into the resonator cavity via the communicating slot. The air in the resonator, on mixing with the incoming rich air-fuel mixture causes it to become more lean.

When the sparkplug ignites the rich fuel-air mixture in the main chamber at or near the end of the compression stroke, a flame front progresses across the combustion chamber. On reaching the communicating slot between the combustion chamber and the Helmholtz resonator, the flame will not propagate through the slot. Rather, the flame is quenched at the slot and only the pressure wave enters. The pressure wave, caused by the exothermic reaction of the combustion process, enters the slot causing a resonant reaction within the Helmholtz cavity. The cyclic phenomena associated with this resonance serves to transfer the lean fuel-air mixture from the resonator cavity into the main combustion chamber. The cyclic frequency of this pumping action is determined by the geometry of the resonator and the dimensional characteristics of the slot.

As more and more of the lean air-fuel mixture is brought from the resonator into the main chamber, two things are achieved. First, there is a spreading of the combustion process over a longer period of time. This reduces the maximum temperature reached during combustion, thereby reducing formation of nitric and nitrous oxides. Second, the addition of the lean air-fuel mixture allows the combustion process to be carried to completion, thereby reducing formation of both carbon monoxide and hydrocarbons.

BRIEF DESCRIPTION OF THE DRAWINGS

Having generally described the invention, the accompanying drawings are shown by way of illustration of a preferred embodiment thereof, in which.

DESCRIPTION OF THE PREFERRED EMBODIMENT

Figure 1:
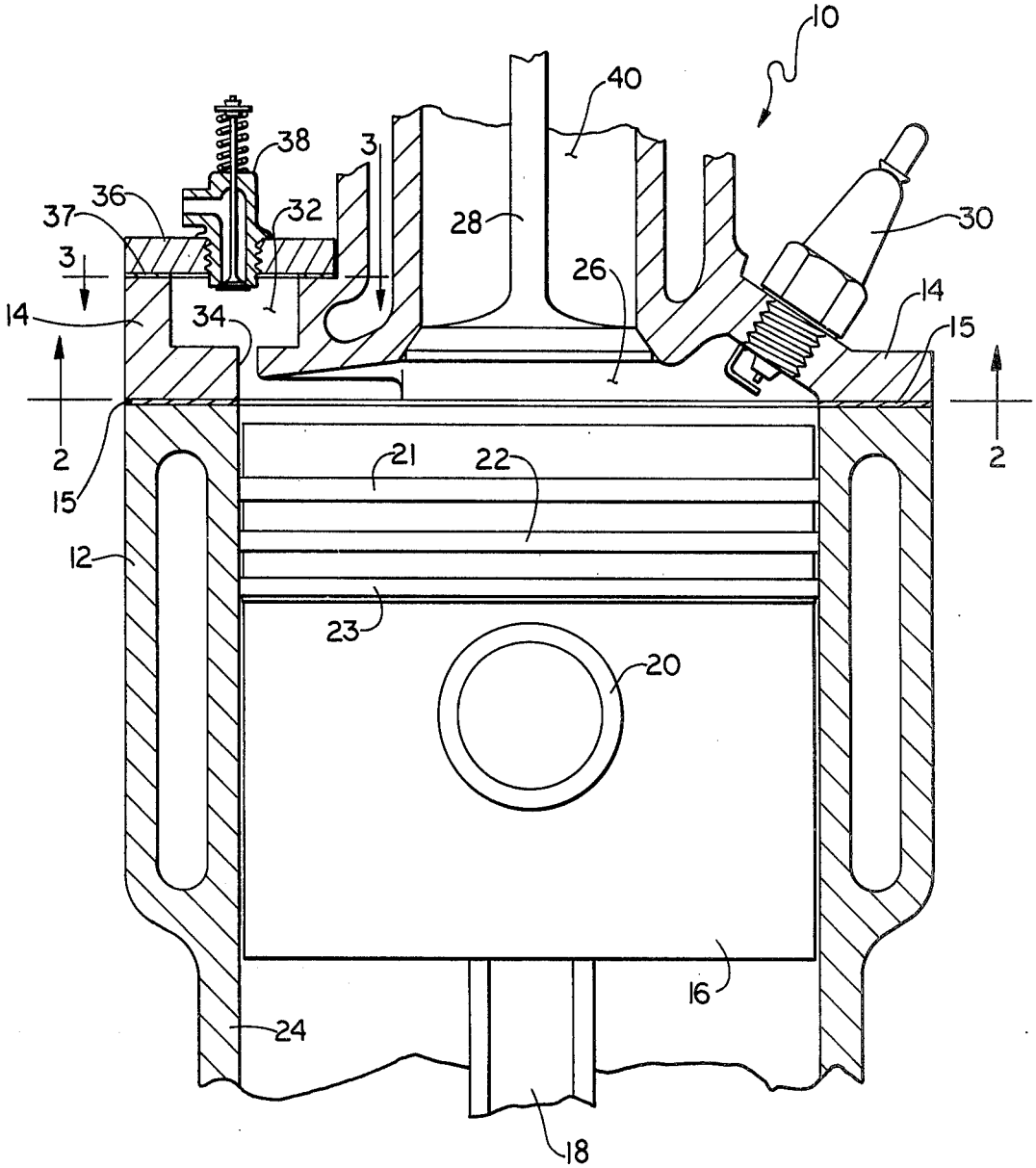
FIG. 1 is a side elevation, fragmentary view through a cylinder of an internal combustion engine provided with a resonator and a communicating slot from the main chamber to the resonator.
Figure 2:
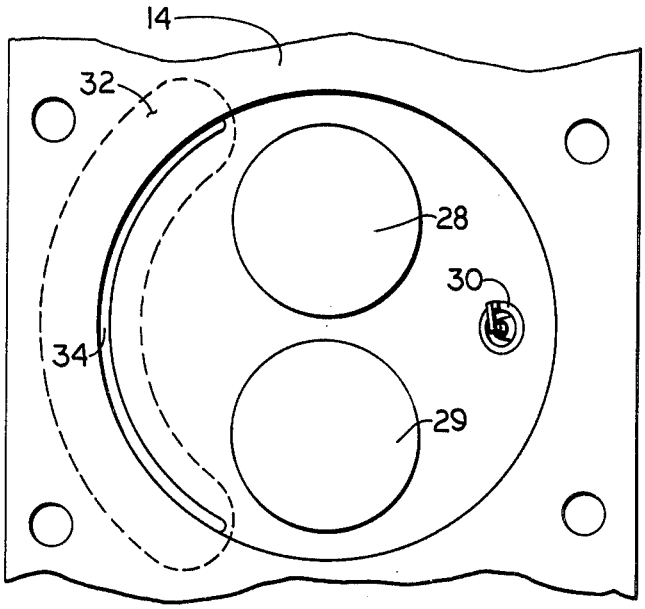
FIG. 2 is a view of the head of the engine taken along line 2—2 of FIG. 1.

Referring to the FIGS. 1 and 2 drawings there is shown one cylinder of a liquid cooled four-stroke cycle engine 10. Only a fragmentary view of a valve-in-the-head type engine is shown. Engine 10 may include one or more cylinder members 12, each having a head member 14 fitted thereto using a head gasket 15 of conventional configuration therebetween. A piston member 16 is carried in each cylinder 12. The reciprocating motion of piston member 16 is converted to circular motion of the crankshaft (not shown) by connecting rod 18. Connecting rod 18 attaches to piston 16 by means of wrist-pin 20. Piston rings 21, 22 and 23 maintain both compression and proper lubrication of the cylinder wall 24.

Typically, piston 16 might be 4.00 inches in diameter and have a 3.50 inch stroke. The change in volume when such a piston moves from top to bottom is 43.98 cu. in. The volume remaining at the top of the cylinder when piston 16 is at top dead center determines the compression ratio. To achieve a compression ratio of 8.33 to 1, the remaining volume of the cylinder chamber at the end of the compression stroke for a 4.00×3.50 in. piston (diameter and stroke) is 6.0 cu. in.

For the engine cylinder shown in FIGS. 1 and 2, the volume at the closed end of the combustion chamber consists of two parts. First, there is the main combustion chamber 26 above the top end of piston 16. On the head 14 side, combustion chamber 26 is closed by intake valve 28 and exhaust valve 29. Combustion chamber 26 is penetrated by sparkplug 30. Second, the volume at the closed end of the combustion chamber includes Helmholtz resonator chamber 32. Resonator chamber 32 communicates with main combustion chamber 26 by means of narrow slot 34.

As shown in FIG. 2, slot 34 extends around the top edge of the engine cylinder and resonator chamber 32 curves to conform to the position of slot 34. Typically, at maximum compression, the system might be configured so that the Helmholtz resonator has half the volume of the main combustion chamber when the piston is at top dead center. For the example given (That is, a 4.00×3.50 in. piston), the 6.00 cu. in. of available volume was divided so that there was 2.00 cu. in. in the Helmholtz resonator 32 and 4.00 cu. in. in the main combustion chamber.

Figure 3:
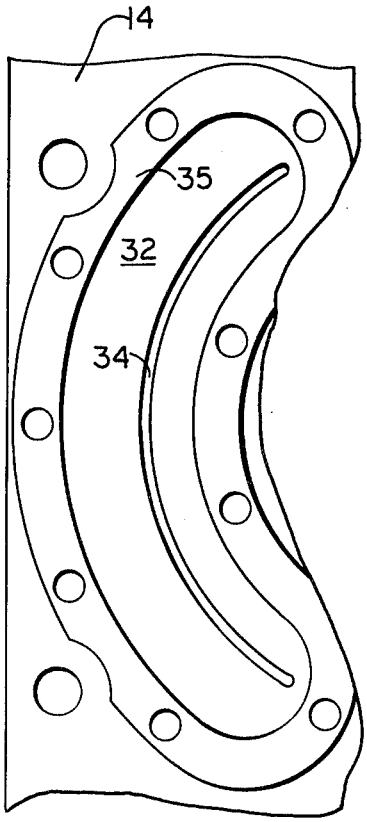
FIG. 3 is a top view of a resonator cavity with cover removed.

Access to resonator cavity 32 is gained through cover 36. This allows the dimensions of both the resonator cavity 32 and slot 34 to be machined to desired tolerance. FIG. 3 shows a top view of resonator cavity 32 with cover 36 removed. A land 35 is milled on head 14 so that cover 36 may be secured thereto using a gasket 37 between head 14 and cover 36. A series of bolts (not shown) are use to secure cover 36 to the head 14.

Figure 4:
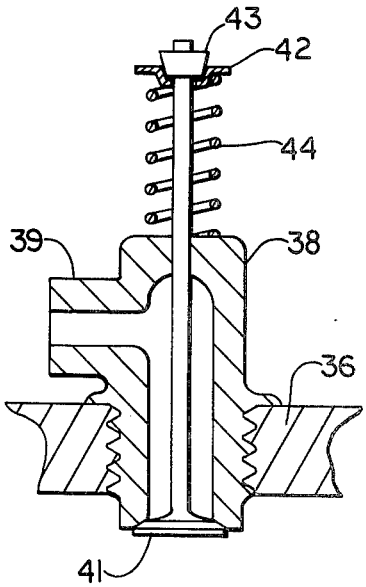
FIG. 4 is a cutaway view of a pressure check valve useful in filling the resonator cavity.

The source of air used to fill the resonator cavity 32, on every intake stroke of the piston, is introduced via threaded fitting 38. Fitting 38 contains means for allowing air to freely flow into resonator cavity 32 during the intake stroke of the piston but, at the same time, prevents air from flowing out during the compression stroke. FIG. 4 shows how this is accomplished. Fitting 38 is threaded for mounting in cover 36. At its inlet end 39, there is provision for attachment of an air supply hose (not shown). Within the body of fitting 38 is a valve 41. Valve 41 seats against the outlet end of fitting 38. It is held against its seat by a spring 44 which acts against washer 42. Washer 42 is secured to the end of the valve stem by keeper 43. The tension in spring 44 is such that valve 41 opens without having to be cammed on the intake or suction stroke of piston 16.

The shape of the intake port 40 and the top of piston 16 are configured to impart a swirling or mixing action to the incoming fuel-air mixture. Homogeneous mixing methods are well known in the art so will not be further discussed here. The goal is to provide a fuel-air charge in the main combustion chamber that has an air/fuel ratio of 14:1. This figure is well known in the art as providing the maximum power ratio for an internal combustion engine (one such reference is the paper entitled, *Balancing Clean Air Against Good Mileage*, by C. M. Heinen and E. W. Beckman, published in the IEEE Spectrum for November, 1977).

If resonator cavity 32 is filled with air during the intake stroke, the overall charge in the cylinder will consist of 47.98 cu. in. of a 14:1 air-fuel mixture in the main combustion chamber 26 and 2.0 cu. in. of air in resonator 32. If this entire charge could be consumed during the ensuing power stroke, the resulting burn cycle would be very nearly stoichiometric. This is because the 2.0 cu. in. of air added to 47.98 cu. in. of 14:1 air-fuel mixture brings the combined air-fuel ratio to about 15:1. Changing the dimensions of resonator cavity 32 would bring about any other desired end result as regards the starting and ultimate air-fuel ratio.

For ease of starting, the test engine can have the air supply to all of the fittings 38 cut off. After the engine is operating at a speed of several hundred revolutions per minute, auxiliary air is turned on and the engine functions in the sustained power stroke mode.

In the sustained power stroke mode, an engine incorporating my invention will produce a pressure-volume curve which differs from the conventional Otto cycle (See, for example, *Mechanical Engineers' Handbook*, edited by T. Baumeister, Sixth Edition, McGraw-Hill Book Co., Inc., p. 9–105). With the Helmholtz resonator cavity, the peak portion of the pressure-volume curve is not smooth. Rather, there is a ripple effect superimposed on the peak portion of the curve. The time duration of each cycle of the ripple is relatable to the resonant frequency of the Helmholtz cavity.

Dimensional constraints of slot 34 concern both the cross sectional area and the depth of the slot. The width of the slot (a nominal 0.100 inch) must be narrow enough so that the flame in the main combustion chamber is quenched at the slot. However, the overall cross sectional area must be sufficiently large to enable attainment of stable conditions at the end of the compression stroke for an engine running a rated cruise speed. Thus, if rated cruise is 2500 rpm, the compression stroke for a four-stroke cycle engine lasts 1.20 ms. and the slot must have enough area to allow gases to flow from the main chamber into the resonator cavity at pressures reaching no more than 120 psia.

As regards the depth of the slot, it is sized in wavelengths for the wavefront which reaches the cylinder edge after the flame front has propagated across the main chamber subsequent to ignition. Propagational velocity and the acoustic phenomena related to ignition of the fuel charge in an engine cylinder is described in detail in U.S. Pat. No. 2,573,536 to Bodine so will not be described here. However, from the teaching of Bodine, it can be inferred that the propagational velocity which pertains as the flame front progresses across the main chamber, is approximately five times the acoustic velocity in air at atmospheric pressure. Using this information then, the depth of slot 34 can be sized to be somewhere between 0.20 and 0.25 inches for satisfactory performance.

Other engine configurations could incorporate my invention. The L-head engine would readily lend itself to incorporation of a Helmholtz resonator in the cylinder head. Coolant circulated around the resonator chamber will prevent the edges of the communicating slot from burning.

For an air-cooled engine, the Helmholtz resonator could encircle the top of the cylinder wall. Access to the resonator could be gained along a circumferential slit at the top of the cylinder. The size of the resonator chamber and the dimensions of the slit will be a function of the design speed of the engine, the octane rating of the fuel and the compression ratio. Use of a supercharger on the engine would necessitate use of pressurized air to fill the resonator cavity.

The Helmholtz resonator chamber will also function as a power stroke extender for a fuel injection type engine. The fuel injection engine simplifies the filling of the resonant chamber adjacent the main combustion chamber in that the intake stroke of the piston causes the entire chamber to be filled with air. Hence, no external source of air is needed to fill the Helmholtz resonator and it can be closed except for the communicating slot with the main combustion chamber. The report titled, *Charge Stratification by Fuel Injection Into Swirling Air,* authored by Hussman A. W., Kahoun F. and Taylor R. A., which appeared in SAE Transactions, Vol. 71, 1963, pages 421–444 describes mixture profiles for various fuel injection engines of the prior art. Addition of my invention to these prior art fuel injection engines would enhance their performance, particularly as regards emission of undesired products of combustion.

To summarize, the engine which I have invented incorporates the transfer of a lean air-fuel mixture from a resonator cavity to the main combustion chamber at an intermediate point of the power stroke in response to a cyclic pressure wave condition within the resonator cavity. This cyclic wave condition continues as the size of the main combustion chamber expands following ignition of the air-fuel charge within the cylinder. Transfer of the lean air-fuel mixture to the main chamber from the resonator cavity via the communicating slot brings about a second phase of combustion over a period of time allowing unburned fuel particles to be consumed while at the same time keeping the peak flame temperature to a level where NOX gas production is minimized.

It is to be understood that in some implementations it may be necessary to utilize more than one Helmholtz resonator cavity per cylinder. This need can occur where the intake and exhaust valve ports when combined with the cylinder head configuration preclude room for a single resonant cavity of sufficient volume to do the required task. For these cases a pair of smaller symmetrically arranged cavities can be used. Even more than two might be required in some implementations. The most important criteria to be considered when adding cavities is that the acoustic frequency of the entire assembly must be such that the output from one cavity does not serve to dampen the pumping action of its companions.

I claim:

1. In combination with a four stroke cycle internal combustion engine of the spark ignition type wherein there is included a cylinder block having at least one cylinder, a piston in the cylinder with a reciprocable stroke volume of predetermined size, a cylinder head formed to provide a main combustion chamber closed at one end and opening into the stroke volume of the cylinder at the other end, an exhaust valve and an intake valve for each cylinder, each positioned for operating into the stroke volume of the cylinder, means for actuating said intake valve and supplying a carbureted fuel rich mixture to the main combustion chamber during the intake stroke of the piston, said intake stroke being followed by a compression stroke wherein the intake valve closes and the piston moves to minimize the volume in the main combustion chamber thereby compressing the fuel rich mixture, means for ignition of the fuel rich mixture near the top dead center position of the piston, ignition of said fuel rich mixture bringing about a power stroke, means for actuating the exhaust valve near the end of said power stroke to allow purging of the main combustion chamber through an exhaust port during the exhaust stroke of the piston, the improvement which comprises:

a Helmholtz resonator cavity of invariable volume adjacent the closed end of the cylinder and in communication with the main combustion chamber of said cylinder via a narrow slot formed at the periphery of the top end of the main combustion chamber, the centerline of said slot being along an arc of equal radius with respect to the center of said piston; and means for filling the Helmholtz resonator cavity with air during said intake stroke of said piston.

2. The invention as described in claim 1 wherein the volume of the Helmholtz resonator cavity is half the minimum volume attained by the main combustion chamber when the piston is at its top dead center position.

3. The invention as described in claim 1 wherein the volume of the Helmholtz resonator cavity is less than half the minimum volume attained by the main combustion chamber when the piston is at its top dead center position.

4. The invention as described in claim 1 wherein the width of the communicating slot is less than 0.10 inches.

5. The invention as described in claim 1 wherein the means for filling the Helmholtz resonator cavity includes attachment of a valved fitting in an opening formed in the exterior wall of said resonator cavity for allowing air to freely flow thereinto during the intake stroke of said piston, but, at the same time said valve fitting serves to prevent air from flowing out during the compression stroke.

6. The invention as described in claim 1 wherein the communicating slot has a uniform depth.

7. The invention as described in claim 6 wherein the depth of the communicating slot is between 0.2 and 0.25 inches.

* * * * *